United States Patent [19]

Ueno

[11] 4,238,314

[45] Dec. 9, 1980

[54] CONTINUOUS ELECTROLYTIC TREATMENT OF CIRCULATING WASHINGS IN THE PLATING PROCESS AND AN APPARATUS THEREFOR

[75] Inventor: Atsuyuki Ueno, Tokyo, Japan

[73] Assignee: Katsuhiro Okuho, Higashi, Japan

[21] Appl. No.: 933,995

[22] Filed: Aug. 16, 1978

[51] Int. Cl.[3] ..... C25C 1/12; C25C 1/20

[52] U.S. Cl. ..... 204/52 Y; 204/46 R; 204/106; 204/109; 204/110; 204/149; 204/130

[58] Field of Search ..... 204/46 R, 52 Y, 78, 204/106, 109, 110, 130, 131, 149, 152, 114

[56] References Cited

U.S. PATENT DOCUMENTS

| | | | |
|---|---|---|---|
| 2,520,703 | 8/1950 | Wagner | 204/114 X |
| 3,431,187 | 3/1969 | Lancy | 204/234 X |
| 3,645,867 | 2/1972 | Ericson et al. | 204/130 |
| 3,658,470 | 4/1972 | Zievers et al. | 204/52 R X |
| 3,756,932 | 9/1973 | Zievers et al. | 204/130 X |
| 3,970,531 | 7/1976 | Recht | 204/130 X |

*Primary Examiner*—Arthur C. Prescott
*Attorney, Agent, or Firm*—Murray Schaffer

[57] ABSTRACT

The washings in a plating process is continuously circulated to an electrolytic cell in communicated with the washing vessel. A metal contained in the washings is deposited on a cathode of the electrolytic cell.

4 Claims, 8 Drawing Figures

CONTINUOUS ELECTROLYTIC TREATMENT OF CIRCULATING WASHINGS IN THE PLATING PROCESS AND AN APPARATUS THEREFOR

BACKGROUND OF THE INVENTION

This invention relates to a continuous electrolytic treatment of circulating washings in plating processes and apparatus therefor.

In general, plated articles are subjected to washing treatment with water. When more economical utilization of water is intended, a plating solution is gradually accumulated in a washing vessel placed adjacent to a plating bath, resulting in a considerable increase of concentration of the plating solution in this washing. As the concentration increases, the plated metal dissolves into the washings of the washing vessel, entailing a deteriorated quality of the plated article. The discharge of such concentrated washings is not be permitted to avoid development of undesired public nuisance.

In order to overcome the foregoing disadvantages, batch processes have been widely employed, which require the addition of a a considerable amount of a treating agent at much additional cost.

After extensive studies, it has been found that a metallic component may be conveniently collected by arranging an electrolytic cell in communication with the washing vessel disposed in abutting relation with a plating bath and providing the cell with a filtering means for the collection of metal, thereby to precipitate the metallic component out of the washings by electrolysis coupled with subsequent filtering. Further, it has also been found that this treatment holds a predetermined concentration of the plating solution in the washings, having an excellent quality of the plated article and at a relatively low cost.

Still further, it has been found that the metallic component may more conveniently be recovered by providing a movable scraper on the cathode of the electrolytic cell for removal and collection of the metals deposited thereon. By periodically operating the scraper, the resulting precipitates can be filtered by a convenient filter connected to the bottom of the electrolytic cell.

SUMMARY OF THE INVENTION

A general purpose of the invention is therefore to provide a continuous electrolytic treatment of circulating washings in plating processes for the effective utilization of the washings and for collection of the by-products. In accordance with the invention, an electrolytic cell is arranged in communication with a washing vessel itself disposed in abutting relation with a plating bath and the cell is provided with a filtering means for collection of metals. The metallic component is precipitated out of the washings to keep the concentration of the plating solution in the washings at a predetermined degree and the resulting precipitates are filtered for the subsequent collection.

It is, therefore, a principal object of the invention is to provide a continuous electrolytic treatment of the circulating washings in the plating process, characterized in that an electrolytic cell is arranged in communication with a washing vessel disposed in abutting relation with a plating bath, so that washings in the washing vessel is continuously circulated through the electrolytic cell to precipitate a metal contained in the washings on a cathode of the electrolytic cell for subsequent collection.

In the method according to the invention, it is preferred to scrape the deposited metals periodically from the cathode and to direct the metals to the bottom of the electrolytic cell for the subsequent collection by filtration. The washings freed of the metal thus obtained may be circulated through the electrolytic cell. Further, it is preferred to replenish the washing vessel with a part of the washings in an amount corresponding to the amount of evaporation in the electrolytic cell with use of at least one other vessel arranged in communication with each other.

Another aspect of the invention is to provide an apparatus for continuous electrolytic treatment of the circulating washings in the plating process which comprises a plating tank, a washing vessel arranged in abutting relation with the plating tank, and an electrolytic cell in communication through a pipe line with the washing vessel. The electrolytic cell having therein a cathode provided with a scraper and an anode, a filtering means for collection of the metal which is connected to a bottom of the electrolytic cell by an on-off valve. The filtering means communicates through a pipe line with the electrolytic cell, and is provided a pumping means for circulation of the filtered washings to the electrolytic cell.

Further, it may be preferable to constitute the apparatus according to the invention in such a manner that the electrolytic cell is of a box shape having a bottom of a hopper shape and adapted to receive therein partitions spaced apart from opposite side walls of the box. One of side walls is connected with an inlet pipe for the washings and the adjoining partition is provided with an opening at its lower part. The other side wall is connected with an outlet pipe for the washings with the other partition being provided with an opening at its upper part, so that the washings may flow through the electrolytic cell.

One way of carrying out the invention is described in detail below with reference to drawings which illustrate specific embodiments.

DESCRIPTION OF THE PREFERRED EMBODIMENTS

Figure 2:
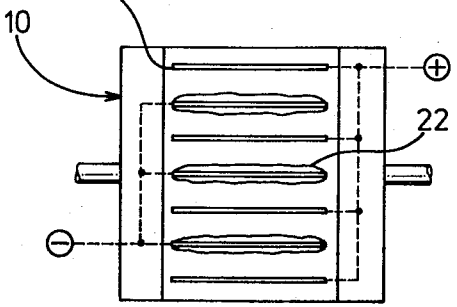
FIG. 2 is a plan view of the aligned electrodes in the electrolytic cell of FIG. 1.
Figure 1:
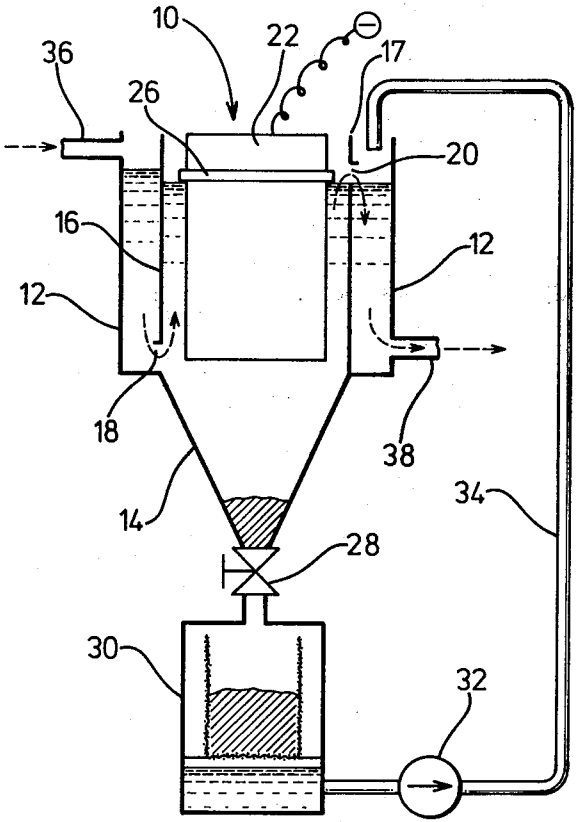
FIG. 1 is a schematic elevational view of the apparatus according to the invention.

In FIG. 1, an electrolytic cell 10 is formed of an upper box 12 and a lower hopper 14. In the electrolytic cell 10, there are arranged partitions 16 and 17 with predetermined spaces. The partition 16 is provided at its lower portion with an opening 18 communicating with the electrolytic cell 10, while the partition 17 is provided at its upper portion with an opening 20 for permitting an over-flowing of the washings from the electrolytic cell. Between the partitions 16 and 17, as hereinafter described, are alternately arranged cathode plates 22 and anode plates 24 at given distances and in parallel to the flow direction of the introduced washings as shown in FIG. 2. The same or similar kind of metal as that of the plating layer may preferably be used for the cathode, while a noble metal or oxide thereof may be used for the anode. Further, it is preferred to arrange a scraper 26 on the cathode 22 in a manually or automatically movable manner. To the bottom end of a hopper 14 is fixed an on-and-off valve 28 which is connected with a filtering means 30 for collection of metal. The filtering means 30 is in turn connected through a pump 32 with a pipe 34 leading to the space above the level of washings in the electrolytic cell 10. The reference numeral 36 denotes a suction pipe of the washings and the numeral 38 denotes a delivery pipe thereof.

The typical process in accordance with the invention is now illustrated by way of an example using a silver-plating process.

Figure 3:
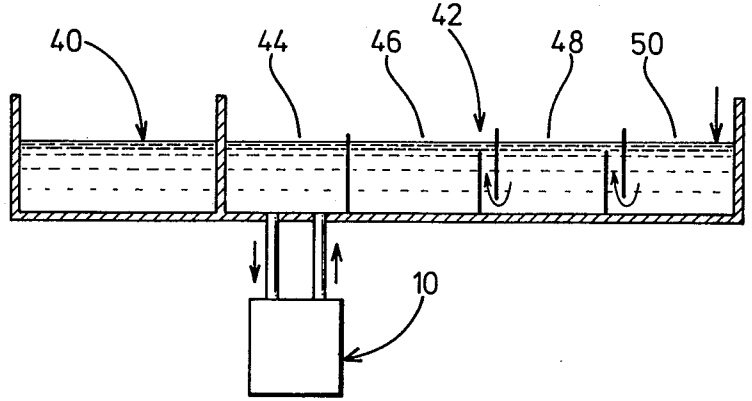
FIG. 3 is a schematic sectional view showing a way of connection of the washing vessel with the apparatus of the invention.

An apparatus according to the invention is connected to a first washing chamber 44 of the washing vessel 42 which is disposed in abutting relation with a silver-plating bath 40 and divided into a plurality of the washing chambers 44 to 55 as shown in FIG. 3. The connection to this washing chamber 44 may be preferably achieved by the suction pipe 36 and the delivery pipe 38 as hereinbefore described. When the washings is supplied successively from the last or fourth chamber 50 through the third and second chambers (48, 46) to the first chamber 44 whereas the silver-plated article which has been plated in the plating bath 40 is, on the contrary, transferred successively from the first chamber 44 through the second and third chambers (46, 48) to the fourth chamber 50, it will be easily appreciated that the plated article is preferably subjected to the washing treatment in a counter-current manner.

Thus, if the first chamber 44 is connected with the electrolytic cell 10, the washings of the highest concentration of the plating solution is continuously electrolyzed in the cell 10. The washings containing the plating solution is introduced through the suction pipe 36 into the upper zone of the electrolytic cell 10, flows down through the opening 18 into the electrolyzing place having the cathodes 22 and the anodes 24, wherein cyan contained in the washings is oxidatively decomposed to an ammonia. Then, the washings overflows through the opening 20 and is recirculated through the outlet pipe 38 to the washing chamber 44. As a result, the concentration of cyan in the washings is extremely reduced and a spongy silver may be deposited on the cathode 22 when the cathode is made from the silver plate. After a large amount of the silver has been deposited, it may be removed from the cathode 22 by means of the scraper 26 and fallen into the hopper 14 of the electrolytic cell 10. After an adequate amount of the silver has been accumulated in the hopper 14, the valve 28 is opened for collection of the silver (Ag) in the filtering means 30, while the filtered electrolytic is circulated by the pump 32 through the pipe 34 to the electrolytic cell 10. The silver thus-obtained has a very high purity and may be advantageously reused. When the plating solution contains impurities such as copper, nickel, zinc and others, the purity of the collected silver decreases due to co-precipitation of the impurities. In such cases, powder of the crude silver obtained may be agitated in 0.1 N sulfuric acid for one hour to give a purity of more than 90%. Alternatively, the crude silver may be electrolytically purified to more than 99.3% by using it as an anode in a silver nitrate solution.

The following examples illustrate the invention.

EXAMPLE 1

| | |
|---|---|
| Capacity of Electrolytic Cell: | 28l |
| Anode: | Titanium-platinium plate |
| Cathode: | Pure silver plate |

Figure 4:
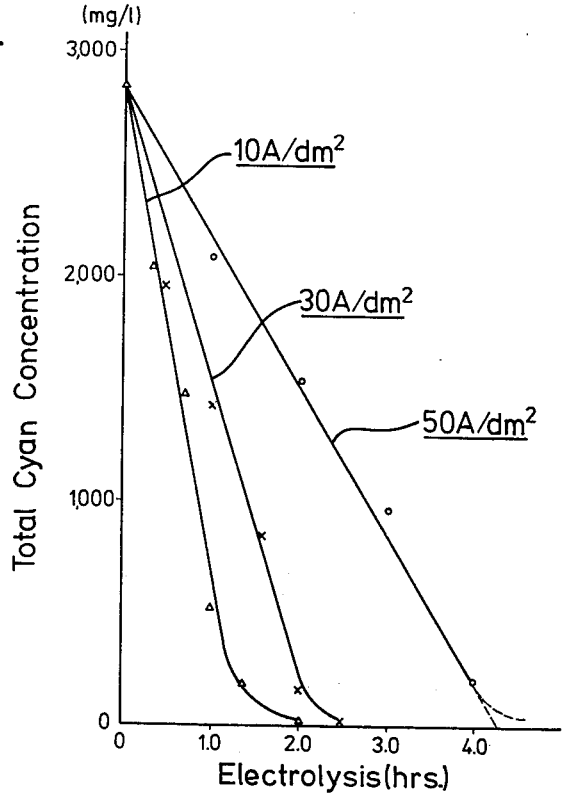
FIG. 4 is a diagram showing characteristic curves of the concentration of cyan in the washings when the washing operation is carried out according to the invention.

The electrolytic cell was arrange to communicate with the first washing chamber arranged in abutting relation with the plating bath, and an electrolysis was carried out under the condition of the electrolytic current of 1.0 A to 5.0 A/dm$^2$. The measurements of the cyan concentration (mg/l) in the first washing chamber is shown in FIG. 4. As apparent from the measurements, the cyan concentration may be reduced within a very short time by selecting the electrolytic current at the required values. In this example, it has been confirmed that the spongy silver deposited on the cathode has a purity of 99.8%.

EXAMPLE 2

The experiments of industrial scale were carried out according to the invention.

In this example, the composition of the plating silver-cyanide solution is as shown in Table 1, and the same condition as in Example 1 was employed for the electrolysis in the electrolytic cell communicating with the first washing chamber.

TABLE 1

| Composition of the Plating Silver Cyanide Solution | |
|---|---|
| Silver | 2.68 g/l |
| Total cyan | 15.8 g/l |
| calculated as KCN | 40 g/l |
| Impurities | |
| Copper | 330 mg/l |
| Zinc | 106 mg/l |
| Iron | 8 mg/l |
| pH | 12.0 |
| Specific conductivity | 60 m υ/cm |

Figure 5:
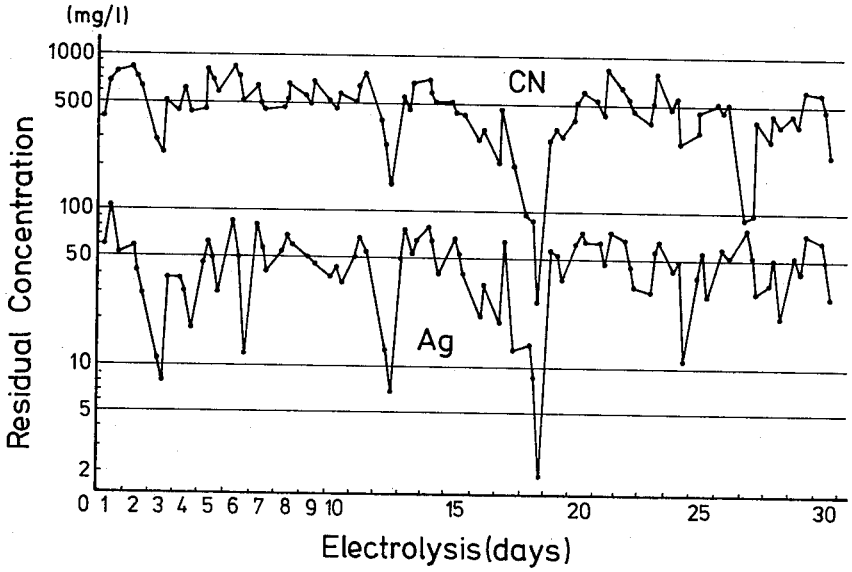
FIGS. 5 to 8 are disgrams showing characteristics of the washings in the other embodiments of the invention, in which FIG. 5 showing the residual concentration of the total cyan and silver, FIG. 6 a residual concentration of impurities, FIG. 7 pH value and FIG. 8 a specific conductivity, respectively.

As a result of the experiments, the residual concentration of total cyan and silver have been confirmed to be equilibrated as shown in FIG. 5.

Figure 6:
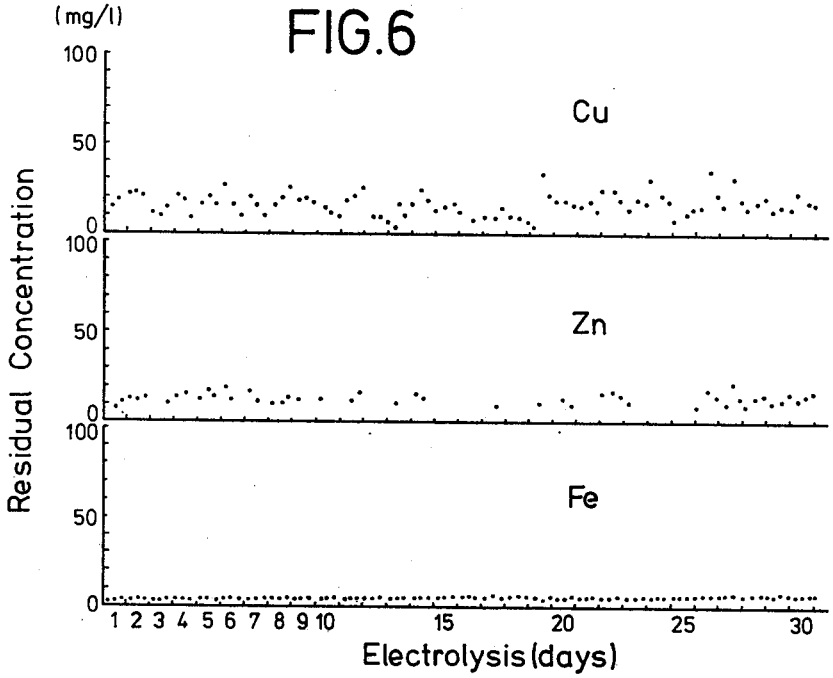

Further, it has also been confirmed that the residual concentrations of the impurities in the first washing chamber are also equilibrated as shown in FIG. 6.

Figure 7:
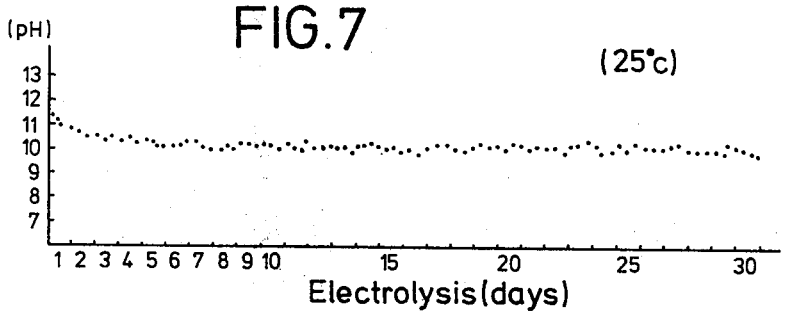
Figure 8:
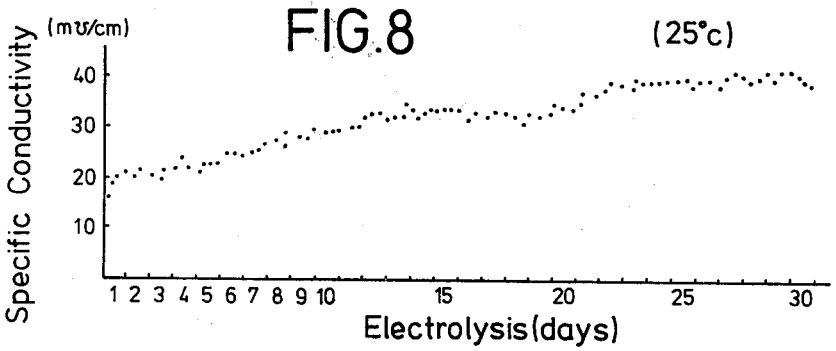

Still further, it has been observed that the pH value and the specific conductivity value are also equilibrated as shown in FIGS. 7 and 8.

On the other hand, the purity of the crude silver collected in the electrolytic cell was determined to obtain the results depending on the purifying conditions, as shown in Table 2.

TABLE 2

| | Collected Crude Silver (%) | Agitation in IN-$H_2SO_4$ (50° C.) 1 hr. (%) | 5 hrs. (%) | Electrolysis in (3N-$H_2SO_4$) (50° C.) | Electrolysis in IN-$H_2SO_4$ | Electrolysis $AgNO_3$ Solution |
|---|---|---|---|---|---|---|
| Ag | 76.5 | 90.5 | 92.2 | 93.8 | 98.6 | 99.3 |

TABLE 2-continued

| | Collected Crude Silver (%) | Agitation in IN-$H_2SO_4$ (50° C.) 1 hr. (%) | 5 hrs. (%) | Electrolysis in (3N-$H_2SO_4$) (50° C.) | Electrolysis in IN-$H_2SO_4$ | Electrolysis $AgNO_3$ Solution |
|---|---|---|---|---|---|---|
| Cu | 8.2 | 5.20 | 5.08 | 3.75 | 0.06 | Trace |
| Zn | 3.8 | 0.96 | 1.22 | 0.60 | Trace | Trace |
| Ni | 2.3 | 1.30 | 0.73 | 0.92 | Trace | Trace |
| Fe | 0.04 | 0.02 | 0.02 | 0.01 | Trace | Trace |
| Total | 90.84 | 97.98 | 99.25 | 99.08 | 98.66 | 99.30 |

As apparent from the foregoing table, very pure silver may be collected.

Accordingly, it will be appreciated that the method according to the invention is very economical for the treatment of the washings in the plating process, if the cost of energy consumption and anodic wastage and the profit of the collected silver in the present invention are compared with the cost of sodium hypochlorite consumption and the non-profit in the waste liquor treatment of the prior art.

According to the invention, the cyan concentration in the washings may be kept at a reduced level and, therefore, an evaporated amount of the washings in the electrolytic cell may be supplied to the washing vessel by way of the adjoining washing chamber communicated each other, resulting in saving of water. Further, silver of high purity may be deposited on the cathode from the washings containing silver together with cyan and the collected silver may be reused for any purposes. Thus, the present invention has many industrial and economical advantages. Moreover, the electrolytic cell of the apparatus according to the invention may be constituted as a very compact and simple structure but may be directly used for the production of the plated articles in an industrial large scale.

In the foregoing, the preferred embodiments have been described for the silver plating as an example. The method and the apparatus according to the invention, however, are not limited thereto and may be effectively utilized for the other plating of metal such as copper, platinum, rhodium, palladium, copper, zinc, cadmium, tin, lead, chrome, iron, nickel or the alloys thereof. Further, the plating bath may be of acidic, neutral or alkaline for the effective collection of metals according to the invention.

The foregoing is to be considered as descriptive and not limitative as many changes and modifications can be made therein without departing from the concept of the invention.

What is claimed is:

1. In a silver or copper plating process, the washings of which have traces of said copper or silver combined with cyanide, the method of continuously monitoring and maintaining the cyanide level in said washings and simultaneously removing the silver or copper traces therefrom comprising the steps of providing a plurality of washing baths in decreasing concentrations of impurity, continuously circulating a portion of said washings from the washing bath having the greatest concentration of impurity through an electrolytic cell having an anode and a cathode through which current is passed, said circulating portion constituting the electrolyte therefor, applying an electrolytic current across said cathode and anode at a selected level sufficient to oxidatively reduce substantially all of said cyanide to ammonia prior to precipitation of said metal and to cause relatively pure metal to be deposited on the cathode of said cell in a soft spongy mass, said electrolytic cell being provided with a hopper arranged at its bottom and periodically scraping said metals from said cathode while said cathode is immersed in the electrolyte, and collecting the same in said hopper for removal and thereafter recycling said electrolyte free of cyanide and metal to the washing bath from which it was taken.

2. The method according to claim 1, including the step of removing residual electrolyte from the metal collected in said hopper and returning said electrolytic cell.

3. The method according to claim 1 including the step of regulating the circulation of the portion of said washings to maintain uniform concentration of impurities in said washings.

4. The method according to claim 1 including the step of adding water to said washings to compensate for evaporation thereof.

* * * * *